US010999674B2

(12) United States Patent
Lambert et al.

(10) Patent No.: US 10,999,674 B2
(45) Date of Patent: May 4, 2021

(54) PRESSURE REGULATOR

(71) Applicant: Fish Guidance Systems Ltd, Fareham (GB)

(72) Inventors: Michael Lambert, Hampshire (GB); Keith Mayne, Hampshire (GB); Tom Latter-Stapley, Hampshire (GB)

(73) Assignee: FISH GUIDANCE SYSTEMS LTD, Fareham (GB)

( * ) Notice: Subject to any disclaimer, the term of this patent is extended or adjusted under 35 U.S.C. 154(b) by 0 days.

(21) Appl. No.: 16/674,322

(22) Filed: Nov. 5, 2019

(65) Prior Publication Data

US 2020/0145750 A1 May 7, 2020

(30) Foreign Application Priority Data

Nov. 7, 2018 (GB) ..... 1818150

(51) Int. Cl.
*H04R 1/44* (2006.01)
*H04R 1/02* (2006.01)

(52) U.S. Cl.
CPC ..... *H04R 1/44* (2013.01); *H04R 1/025* (2013.01)

(58) Field of Classification Search
CPC ..... H04R 1/44; H04M 1/035
USPC ..... 381/165, 334
See application file for complete search history.

(56) References Cited

U.S. PATENT DOCUMENTS 5,103,432 A * 4/1992 Percy ..... H04R 1/44 367/172
5,316,448 A * 5/1994 Ziegler ..... F04C 28/26 417/307
5,815,589 A * 9/1998 Wainwright ..... H04R 3/14 181/144
2018/0015363 A1* 1/2018 Monnin ..... H01Q 1/38
2018/0084339 A1* 3/2018 Asuncion ..... H04R 1/023

FOREIGN PATENT DOCUMENTS

| | | | |
|---|---|---|---|
| CN | 107682780 | A | 2/2018 |
| JP | S58-29293 | A | 2/1983 |
| JP | S61-80996 | A | 4/1986 |
| JP | H08-251687 | A | 9/1996 |

OTHER PUBLICATIONS

Patents Act 1977: Search Report under Section 17(5) for GB Application No. 1818150.3, dated May 8, 2019, 3 pages.

* cited by examiner

*Primary Examiner* — Alexander Krzystan
(74) *Attorney, Agent, or Firm* — William H. Bollman

(57) ABSTRACT

The present invention relates to a pressure regulator and in particular to a closed active pressure regulator gas coupled to an acoustic device which is disposed underwater. The pressure regulator comprising an internal pressure sensor, a valve, and a gas supply each coupled to a processor, at least said valve, gas supply and processor disposed within a fluid tight housing, said pressure regulator including an external pressure sensor coupled to the processor though the housing, whereby said pressure regulator is gas coupled to an acoustic device disposed underwater, said acoustic device contained within a pressure sealed and fluid tight container, said pressure regulator is a closed active system for removing gas from the container to the gas supply or supplying the gas from the gas supply to the container thereby regulating the pressure in the container.

8 Claims, 2 Drawing Sheets

PRESSURE REGULATOR

CROSS-REFERENCE TO RELATED APPLICATION

The present application claims priority to Great Britain Application No. 1818150.3, filed on Nov. 7, 2018, which is incorporated herein by reference.

FIELD

The present invention relates to a pressure regulator and in particular to a closed active pressure regulator gas coupled to an acoustic device which is disposed in a fluid typically underwater.

BACKGROUND PRIOR ART

An acoustic device, such as a speaker, can be deployed underwater for many uses such as guiding fish, providing entertainment etc. However, as the depth of the acoustic device or underwater speaker increases, the external pressure increases proportionally. This pressure increase affects the acoustic response of the underwater speaker due to the external and internal differential pressure. As such the effectiveness of the speaker is reduced.

In response to this problem, the internal pressure around the speaker system can be increased to reduce the pressure differential. It has been proposed that this could be achieved through a passive pressure regulation system by way of a pressurised, compressible external vessel. As the depth and pressure increases, the pressurised vessel is compressed and air is forced into the internal acoustic chamber.

This method of passive gas pressure regulation is limited by the properties of the external vessel and can only be used at low depths. For example, when a speaker is disposed in a neoprene bag in salt water and depths of no more than 25 m, under long term use, i.e. periods of 9 months or so, the neoprene bag loses pressure and the gas therefore needs to be replaced.

In response to increasing pressure at depth, alternative methods of passive pressure compensation have been developed: see for example the pressure compensators from Link: Fathom Systems Ltd. Typically, these systems operate at depths of greater than 1000 m where pressures exceed $1\times10^7$ Pa. These systems are designed for use with electronic or hydraulic systems that can be submerged in hydraulic fluid due to the compressibility of air at these extreme depths limiting the pressure compensation systems working range. As the pressure increases with depth, the piston, which is exposed on one surface to the water, compresses the hydraulic fluid and increases pressure inside the electronics chamber. A disadvantage of a passive oil filled pressure compensation system is that they do not allow pressures to be regulated to high resolution e.g. tens of Pascals. In addition, the systems require a fluid filled enclosure for the electronic equipment.

In JPH8-251687, there is disclosed a pressure equalizing device for an underwater sound source. This pressure equalizer includes a diaphragm for generating the sound open to the water. A compression tank together with flow rate control valves and gas injection and gas exhaust lines are used to try and maintain the pressure to the other side of the diaphragm.

Again such pressure equalizing is limited due to poor sealing of the sound source such that a constant gas supply is needed and the equalization occurs through varying the flow rate of the gas supplied or when exhausted, released to the sea. Accordingly, such a system is relatively crude and is unable to be used at greater depths with any degree of accuracy. In particular, the system is not a closed system, requiring constant recharging of the gas supply leading to its inability to be located at certain sites where constant recharging is not possible through operational difficulties such as depth or access.

Thus, it is the aim of the present invention to mitigate such disadvantages of passive gas or oil pressure equalizing systems The present invention thus relates to a pressure regulator comprising an internal pressure sensor, a valve, and a gas supply each coupled to a processor, at least said valve, gas supply and processor disposed within a fluid tight housing, said pressure regulator including an external pressure sensor coupled to the processor though the housing, whereby said pressure regulator is gas coupled to an acoustic device disposed underwater, said acoustic device contained within a pressure sealed and fluid tight container, said pressure regulator is a closed active system for removing gas from the container to the gas supply or supplying gas from the gas supply to the container, thereby regulating the pressure in the container.

BRIEF DESCRIPTION OF THE DRAWINGS

Embodiments of the present invention will now be described by way of example only and with reference to the accompanying drawings, of which.

DETAILED DESCRIPTION OF ILLUSTRATIVE EMBODIMENTS

Figure 1:
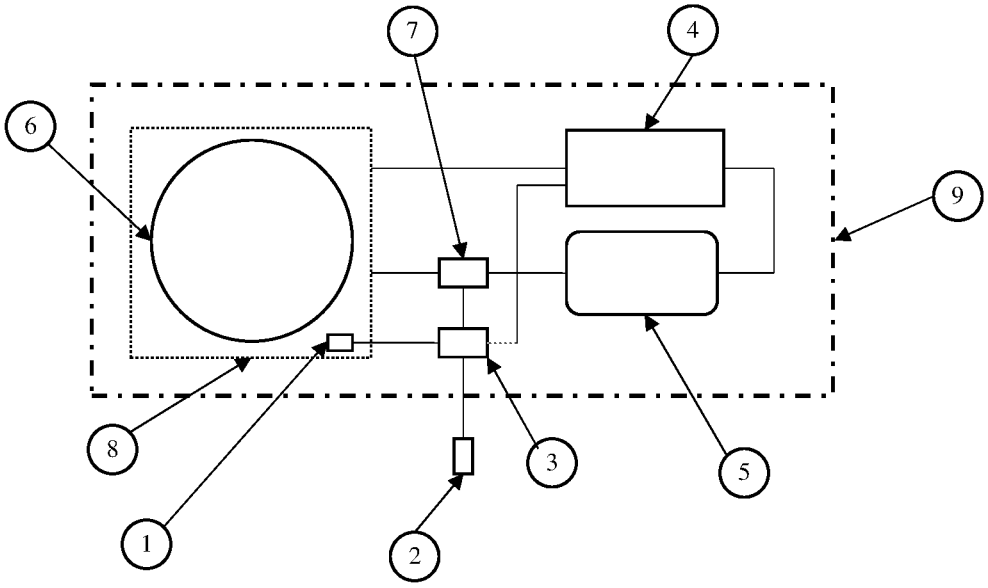
FIG. 1 is a schematic diagram of the present invention including an acoustic device.

In FIG. 1 there is shown an acoustic device in the form of a loudspeaker 6 and in close proximity an internal pressure sensor 1. The acoustic device and internal pressure sensor are contained within a pressure sealed and fluid tight container 8. The container is fluid impervious to a fluid such as water and is typically sealed to contain under pressure, a fluid such as air or a gas such as nitrogen especially in high humidity areas.

In contrast to the prior art example of the neoprene bag, the present invention deploys active pressure regulation. Accordingly, the internal pressure sensor 1 of the pressure regulator is coupled to a microprocessor or computer 3. The pressure regulator also includes a compressor 4 coupled to the acoustic device 6 and/or fluid tight container to remove fluid from the pressure tight (acoustic) chamber 8 as the water level increases, thus reducing the pressure in the acoustic chamber 8. The compressor is also coupled to the microprocessor 3. A gas storage container 5 receives gas from the compressor 4 and is connected to a valve 7 which is also connected to the microprocessor 3 and the acoustic chamber 8.

The pressure regulator is contained with a fluid or water tight housing 9 to which is attached an external pressure sensor 2. The fluid or water tight housing is fluid impervious to a fluid such as water and may also be sealed to contain under pressure, a fluid such as air or a gas such as nitrogen. The external pressure sensor 2 is also coupled to the microprocessor 3.

The coupling of the various elements to the pressure sealed and fluid tight areas is effected by way of seals known to persons skilled in the art, e.g. o rings, dual rubber o rings and/or threaded connections.

In operation, the microprocessor 3 receives information from the internal pressure sensor regarding the pressure inside, adjacent or in proximity to the acoustic device 6 and compares the same with information received from the external pressure sensor 2. Needless to say, the external and internal pressure sensors are disposed at the same depth within a tolerance of preferably +/−0.01 m but tolerances of between 0.01 m and 0.5 m are envisaged.

Alternatively, the external and internal pressure sensors may be disposed at different depths or outside of the depth tolerance and the microprocessor applies a calibration offset.

If the pressure difference between the external and internal pressure sensors exceeds a predetermined tolerance, then the microprocessor 3 instructs the valve 7 to release gas from the gas storage container 5 to increase the gas pressure around the acoustic device 6. Conversely if the gas pressure is too great in the acoustic container 8, then the microprocessor instructs the valve 7 to activate and instructs the compressor 4 to enable gas to be stored in the gas storage container 5.

Figure 2:
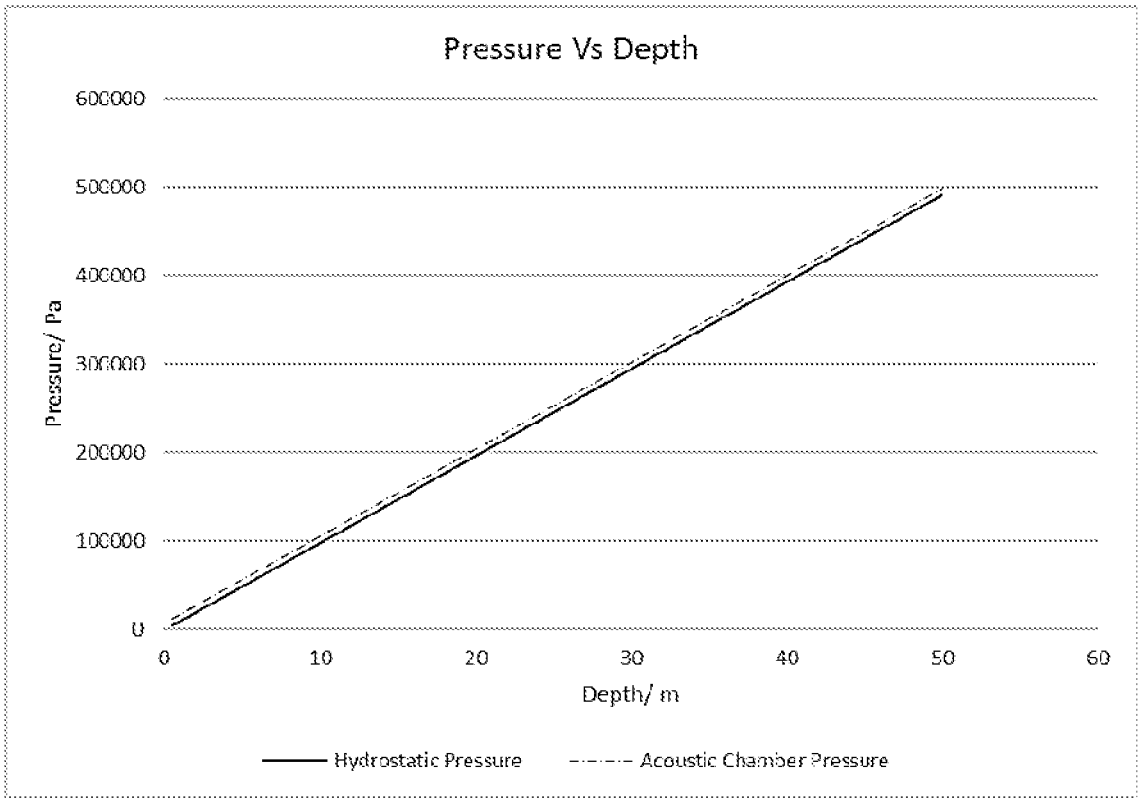
FIG. 2 is a graph showing the maintenance of a set pressure differential between the acoustic chamber and the hydrostatic pressure at varying depths.

The graph in FIG. 2 illustrates how the pressure within the acoustic chamber varies with depth. Preferably, the acoustic chamber is maintained at a constant pressure of anywhere between 0 Pa and 100 kPa, and most preferably 7.5 kPa above the hydrostatic water pressure across a depth range of 0 m to 100 m with a predetermined tolerance of pressure differential of between 1 Pa and 1 kPa and most preferably a pressure differential tolerance of 10 Pa.

A feedback loop develops such that when the two pressures from the internal and external pressure sensors are within the predetermined tolerance, then the microprocessor instructs the valve to shut.

As is the case with tidal water levels and varying river water heights, when the water level drops, the pressure in the acoustic chamber will need to decrease to maintain the predetermined pressure differential. Therefore, the microprocessor 3 instructs the gas compressor to remove air from the acoustic chamber which is stored in the gas storage container 5. When the two pressures from the internal and external pressure sensors are within the predetermined tolerance, then the microprocessor instructs the gas compressor to switch off.

The present invention thus enables the gas pressure around the acoustic device to be increased and/or decreased to enable a more efficient acoustic response of the acoustic device irrespective of the depth at which the acoustic device is deployed.

As gas is compressed and stored in the gas storage container 5 and then released when required into the acoustic chamber, the pressure regulator is a closed system. Accordingly, replenishment is not required and the pressure regulator can be deployed at greater depths, difficult access areas and over a longer period of time than known hitherto; possibly up to 10 years. In addition, the present invention has far greater resolution than known previously e.g. 01. kPa over 30 m and 0.3 kPa over 100 m.

The present invention provides a closed active pressure regulation relatively quickly too which is most desirable in areas of dramatic changes in water depth. The microprocessor can react within 1 second of any pressure changes. Any increase in water depth and so raising of the internal pressure can be achieved much more quickly than decreasing the internal pressure. For example, the present invention can achieve a rate of change of depth of 5 m and so changes of 50 kPa per minute.

The pressure regulator is supplied with a power source not shown.

In FIG. 1, the acoustic device is shown within the watertight housing 9 of the pressure regulator. Thus, the watertight housing 9 may also need to be pressure sealed; particularly if the acoustic chamber 8 is omitted. In which case, references to the gas pressure in the acoustic container refer to gas pressure in the regulator housing.

Figure 3:
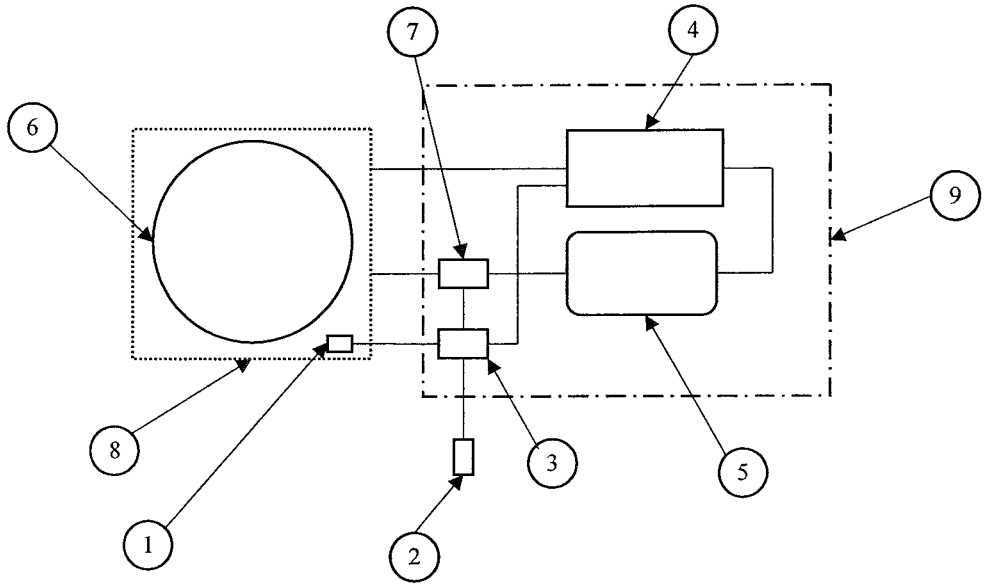
FIG. 3 is a schematic diagram of an alternative embodiment of the present invention coupled to an acoustic device.
Figure 4:
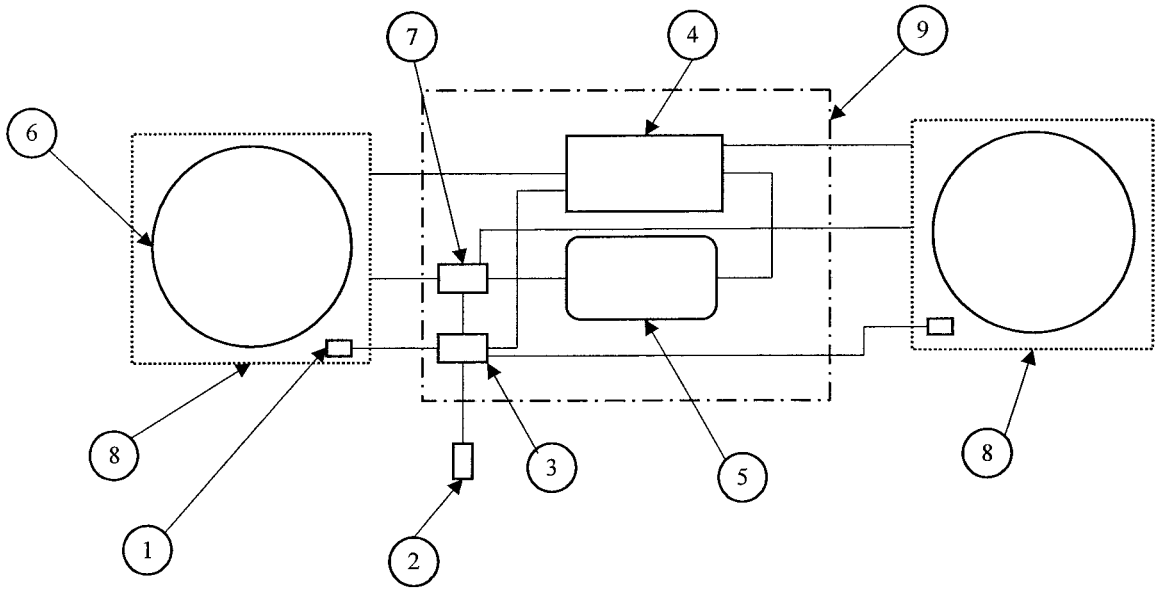
FIG. 4 is a schematic diagram of another alternative embodiment of the present invention coupled to two acoustic devices.

FIGS. 3 and 4 depict alternative embodiments of the present invention. In these two instances, the acoustic device 6 or devices 6 within the respective acoustic chamber 8 is disposed outside of the waterproof housing 9.

FIG. 4 depicts the pressure regulator coupled to two acoustic devices. The same pressure regulator regulates the pressure within each pressure sealed and water tight container housing each containing a respective acoustic device. The acoustic devices may or may not be at the same depth and so require the same or different pressure. The pressure regulator may thus require two or more valves each coupled to a respective acoustic device to ensure optimum pressure regulation around the respective acoustic device. Needless to say, the present invention also encompasses two or more acoustic devices in the embodiments shown in FIGS. 1 and 3.

The invention claimed is:

1. A pressure regulator system comprising
- an internal pressure sensor,
- a valve,
- a gas supply, and
- a processor coupled to each of the internal pressure sensor, said valve, and said gas supply,
- wherein at least said valve, said gas supply, and said processor are disposed within a fluid tight housing,
- said pressure regulator system further comprising an external pressure sensor attached external to the housing and coupled electrically to the processor though the housing, the internal pressure sensor being attached internal to the housing,
- wherein said pressure regulator system is gas coupled to at least one acoustic device disposed underwater, said at least one acoustic device being contained within a pressure sealed and fluid tight container, and
- said pressure regulator system is a closed active system which both removes gas from the container to the gas supply and supplies gas from the gas supply to the container as required to thereby regulate a pressure in the container.

2. The pressure regulator system as claimed in claim 1, wherein
- said internal pressure sensor and said external pressure sensor are disposed at a same depth underwater.

3. The pressure regulator system as claimed in claim 1, wherein
- said internal pressure sensor and said external pressure sensor are not disposed at a same depth underwater, and
- the processor applies a calibration offset to a measurement from at least one of said internal pressure sensor and said external pressure sensor.

4. The pressure regulator system as claimed in claim 1, wherein said at least one acoustic device is contained within said fluid tight housing.

5. The pressure regulator system as claimed in claim 1, wherein said gas supply comprises a compressor; and a storage chamber, wherein said compressor is coupled to the processor, and the storage chamber is coupled to the valve.

6. The pressure regulator system as claimed in claim 1, wherein the at least one acoustic device comprises at least two acoustic devices.

7. The pressure regulator system as claimed in claim 6, wherein each of the at least two acoustic devices are each disposed at a different depth underwater.

8. The pressure regulator system as claimed in claim 1, wherein air pressure in the container is regulated to be equal to or greater than water pressure outside of the housing.

* * * * *